US009493301B2

(12) United States Patent
James et al.

(10) Patent No.: US 9,493,301 B2
(45) Date of Patent: Nov. 15, 2016

(54) BIN RETAINER PANEL

(75) Inventors: Gary W. James, Parma Heights, OH (US); Judy Kalski, Westlake, OH (US)

(73) Assignee: Metal Fabricating Corporation, Cleveland, OH (US)

( * ) Notice: Subject to any disclaimer, the term of this patent is extended or adjusted under 35 U.S.C. 154(b) by 704 days.

(21) Appl. No.: 13/486,413

(22) Filed: Jun. 1, 2012

(65) Prior Publication Data

US 2012/0305732 A1 Dec. 6, 2012

Related U.S. Application Data

(60) Provisional application No. 61/493,014, filed on Jun. 3, 2011.

(51) Int. Cl.
*B65D 90/00* (2006.01)
*A47B 97/00* (2006.01)

(52) U.S. Cl.
CPC ..... *B65D 90/0046* (2013.01); *A47B 97/00* (2013.01); *B65D 2543/0012* (2013.01); *B65D 2543/00481* (2013.01); *Y10T 29/49826* (2015.01)

(58) Field of Classification Search
CPC ..... A47B 97/00; Y10T 29/49826; B65D 90/0046; B65D 2251/00; B65D 2251/0003; B65D 2543/0012; B65D 2543/00481
USPC ..... 428/582, 596, 603; 220/23.9, 254.1, 220/254.7, 523, 526
See application file for complete search history.

(56) References Cited

U.S. PATENT DOCUMENTS

| | | | | |
|---|---|---|---|---|
| 2,003,326 | A * | 6/1935 | Wellman | 229/109 |
| 2,420,625 | A * | 5/1947 | Stalnaker et al. | 206/595 |
| 2,638,643 | A * | 5/1953 | Olson | 428/577 |
| 2,666,238 | A * | 1/1954 | Hagedorn | E04B 1/2608 403/189 |
| 2,748,452 | A * | 6/1956 | Pierce | 29/865 |
| 2,960,761 | A * | 11/1960 | Preader | 428/582 |
| 4,074,495 | A * | 2/1978 | Bodnar | 52/630 |
| 4,557,876 | A * | 12/1985 | Nutter | 261/94 |
| 4,572,695 | A * | 2/1986 | Gilb | E04B 1/2608 248/300 |
| 4,619,870 | A * | 10/1986 | Mitchell et al. | 428/596 |
| 5,568,680 | A * | 10/1996 | Parker | 29/557 |
| 7,198,242 | B1 * | 4/2007 | Bently | F24F 13/082 248/300 |
| 2011/0300399 | A1 * | 12/2011 | Kirchner et al. | 428/603 |

* cited by examiner

*Primary Examiner* — Michael Safavi
(74) *Attorney, Agent, or Firm* — Fay Sharpe LLP; James E. Scarbrough

(57) ABSTRACT

A bin retainer panel has a planar wall having a first end having a bent edge extending along a length of the first end; and first and second side ends each having edges bent at an acute angle with respect to the planar wall. The first and second side edges each has a plurality of protrusions formed thereon. A bin retainer panel has a planar wall having a first end having a bent edge and a second, opposite end having a bent edge; and first and second side ends. The first side end has an edge bent at an acute angle with respect to the planar wall. The first side end edge has a plurality of protrusions formed thereon.

10 Claims, 8 Drawing Sheets

BIN RETAINER PANEL

CLAIM OF PRIORITY

This application claims priority from Provisional Patent Application No. 61/493,014, filed on Jun. 3, 2011 which is hereby incorporated by reference in its entirety.

BACKGROUND OF THE DISCLOSURE

The present disclosure relates generally to storage cabinets or bins and the like, and more particularly to a bin retainer panel for use with a storage cabinet with shelves which is shipped and packed in shipping containers.

It is generally known to provide a cabinet structure into which one or more shelves are mounted. In certain applications, the shelves are compartmentalized or otherwise configured to hold screws, nuts, bolts, and other articles. The shelves are intended to be normally used in a horizontal position.

The metal storage bins or cabinets are often used in military facilities or operations. The metal storage cabinets or bins with shelves are often shipped with articles such as bolts, nuts, etc. stored within the bin with the bin on its side and with the shelves in a vertical position. As such, the bolts, nuts, screws or other parts can fall or move around during shipment. The bin or cabinet is also often shipped on its side, i.e. when the shelves are positioned vertically instead of horizontally or upright during normal use.

The cabinet or bin also has a pair of doors which are closed and locked during shipment. During use, the doors are removed from the bin which is tilted to its upright position with the shelves in the normal horizontal position.

Thus, there is a need for a retaining panel which is used for retaining articles within compartments formed by shelves of a bin during shipment which overcomes the above-mentioned deficiencies while providing better overall results.

SUMMARY OF THE DISCLOSURE

In accordance with a first aspect of the present disclosure, a cabinet structure includes shelves which form storage compartments within the cabinet. A bin retaining panel is inserted onto the storage bin and has tabs or protrusions which are received by slots or openings formed by the shelves. The bin retaining panel is preferably made of a thin sheet of metal and is bendable or flexible. The panel can be made of various suitable thicknesses. Furthermore, other suitable materials are contemplated.

The bin retaining panel also has a cut-out or opening configured to receive a lock assembly for one of the shipment container doors.

Edges of the bin retaining panel are bent up at about 90 degrees to engage with an edge of the container door. The edges on the panel also put pressure on the panel to stay in position.

A bottom end of the panel mates with the bottom of the bin. The door frame is positioned on and places pressure on the bottom of the panel.

In accordance with one aspect of the disclosure, a bin retainer panel has a planar wall having a first end having a bent edge extending along a length of the first end; and first and second side ends each having edges bent at an acute angle with respect to the planar wall; wherein the first and second side edges have a plurality of protrusions formed thereon.

In accordance with another aspect of the disclosure, a bin retainer panel has a planar wall having a first end having a bent edge and a second, opposite end comprising a bent edge; and first and second side ends wherein the first side end has an edge bent at an acute angle with respect to the planar wall, wherein at least the first side end edge has a plurality of protrusions formed thereon.

In accordance with another aspect of the disclosure, a method of using a bin retainer panel includes the steps of tilting a storage bin on its side; unlocking doors of the bin by unlocking and removing a locking member from the doors; lowering a bin retainer panel onto the bin and flexing and bending the panel to seat onto the bin; engaging protrusions on the panel with gaps formed between shelves of the bin; seating the panel on outer edges of the shelves; closing the doors of the bin; and locking the doors using the locking member which extends through an opening of the panel.

One advantage of the present disclosure is that it provides a bin retaining panel that is installed onto a shelved bin for retaining articles within the bin.

Another advantage of the present disclosure is that it is easily installed and removed and is cost-effective.

Still another advantage of the present disclosure is that panel allows for easy installation of the panel on the bin by flexing or bending the panel.

A further advantage of the present disclosure is that it facilitates accurate horizontal placement of the panel by easy installation of the tabs on the panel into slots formed by the shelves.

Another advantage of the disclosure is bent ends which mate with door frames to retain the panel in position on the bin.

Another aspect of the disclosure is an opening which has a profile of a lock to accommodate a lock of the door.

Still other aspects of the disclosure will become apparent to those skilled in the art upon reading and understanding the following detailed description.

BRIEF DESCRIPTION OF THE DRAWINGS

The disclosure may take physical form in certain components and arrangements of components, preferred embodiments of which will be described in detail in this specification and illustrated in the accompanying drawings which form a part hereof and wherein.

DETAILED DESCRIPTION OF THE PREFERRED EMBODIMENT

Figures 1, 2:
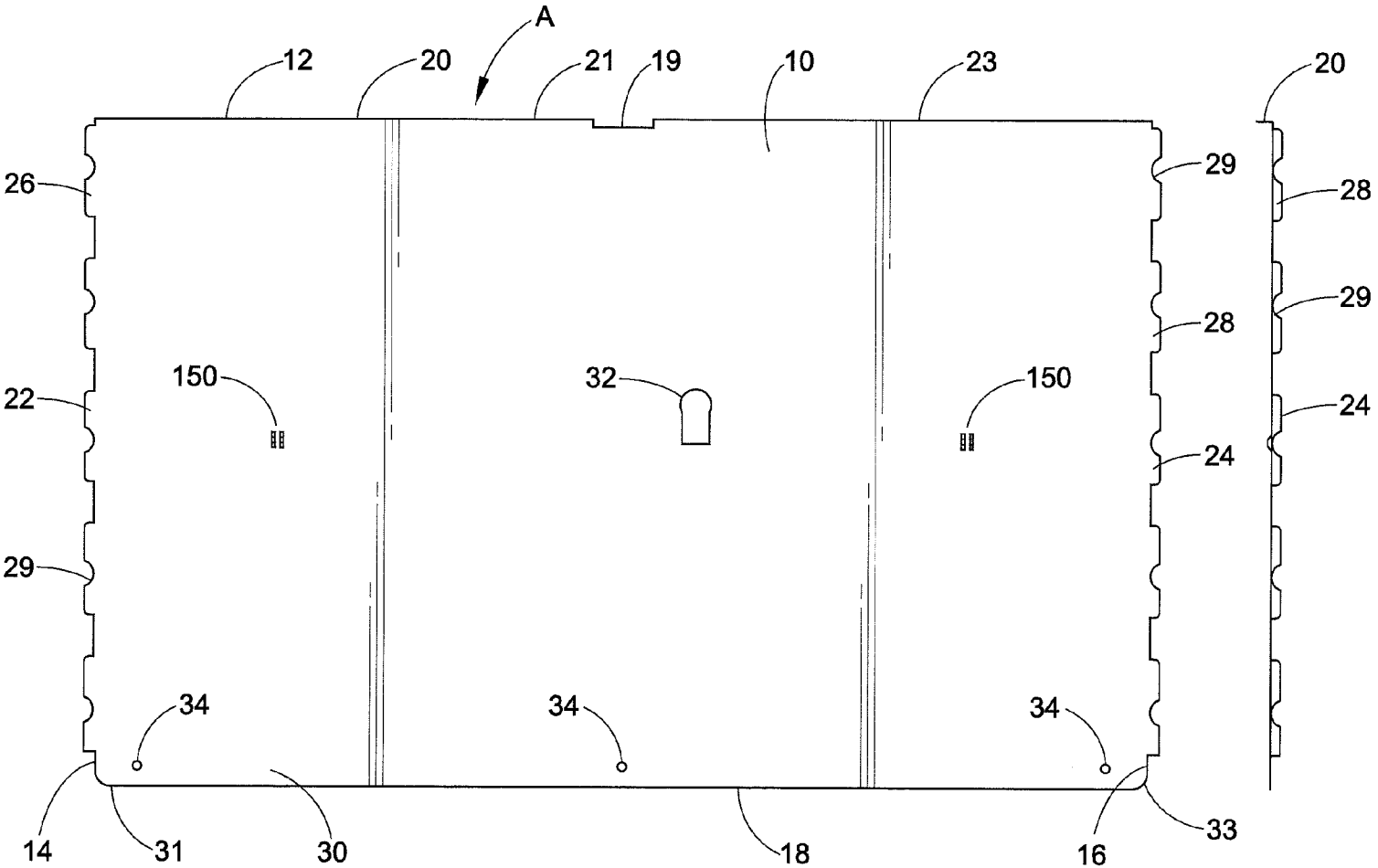
FIG. 1 is a top plan view of a bin retaining panel in accordance with one aspect of the disclosure.
FIG. 2 is a right side elevational view of the panel of FIG. 1.
Figure 3:
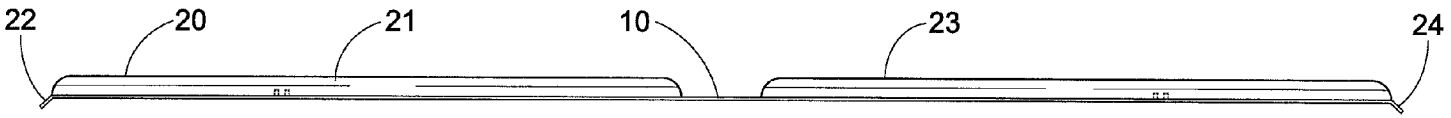
FIG. 3 is a front elevational view of the panel of FIG. 1.
Figure 4:
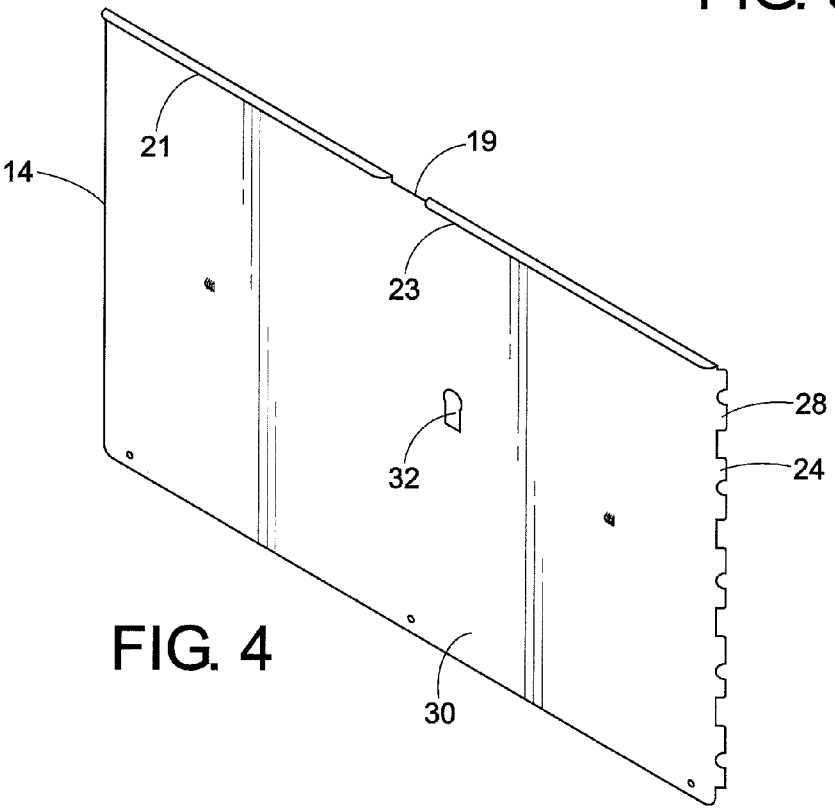
FIG. 4 is a perspective view of the panel of FIG. 1.

Referring now to FIGS. 1-4, a preferred embodiment of the present disclosure is shown. Bin retaining panel A has a generally flat planar wall 10 which has ends 12, 14, 16, 18 forming a generally rectangular configuration. The bin retaining panel is fabricated from preferably a thin sheet of metal. Upper or first end 12 has a bent edge 20 which is bent at about 90 degrees with respect to the planar wall 10. Edge 20 has two half sections 21, 23 to accommodate and retain the ends of the doors in a closed configuration. Edge 20 also helps put pressure on the panel with the door resting on the panel and retain the panel in position. Edge 18 also helps apply pressure to the panel from the door resting on top of the panel. Sections 21, 23 each have rounded edges but straight edges are also contemplated by the disclosure. A notch or gap 19 can be formed between walls 21, 23 to accommodate ends or edges of two doors. Edge 20 extends upwardly (i.e., out of the page) as shown in FIG. 1. Side ends 14, 16 have a bent edge 22, 24 which are bent downwardly or into the page as shown in FIGS. 2 and 3. Edges 22, 24 are bent at an acute angle with respect to wall 10 of about 45 degrees or so. Edges 22, 24 have a series of tabs or protrusions 26, 28 which are sized and configured to engage mating slots 138 formed in shelves of a bin. For example, protrusions 26, 28 can have a rectangular or square shape but other configurations such as angled or rounded shapes are also contemplated by the disclosure. Protrusions 26, 28 can have a substantially C-shaped or rounded or curved notch 29 formed therebetween for accommodating a shelf wall. Other shapes and configurations of notches or cut-outs are also contemplated by the disclosure. Protrusions 26, 28 engage slots or openings 138 in the shelf wall and help align and maintain the protrusion of the panel Bottom end 18 has a straight edge portion 30 which is not bent with respect to planar wall 20. Edge 30 is shown to have rounded or radiused corners 31, 33, but straight corners could be used as well. Positioned on the planar wall is a slot or opening 32 which is sized and configured to receive a correspondingly locking member for a door of the shipping container. Opening 32 can be placed centrally on panel in various positions on the planar wall as discussed. A plurality of holes 34 can also be formed on the panel for hanging the panel when not in use.

Referring now to FIGS. 5-8, an alternate embodiment of the bin retaining panel B is shown. Panel 40 also has a generally flat planar wall 42 which is generally rectangular in configuration.

Figures 5, 6:
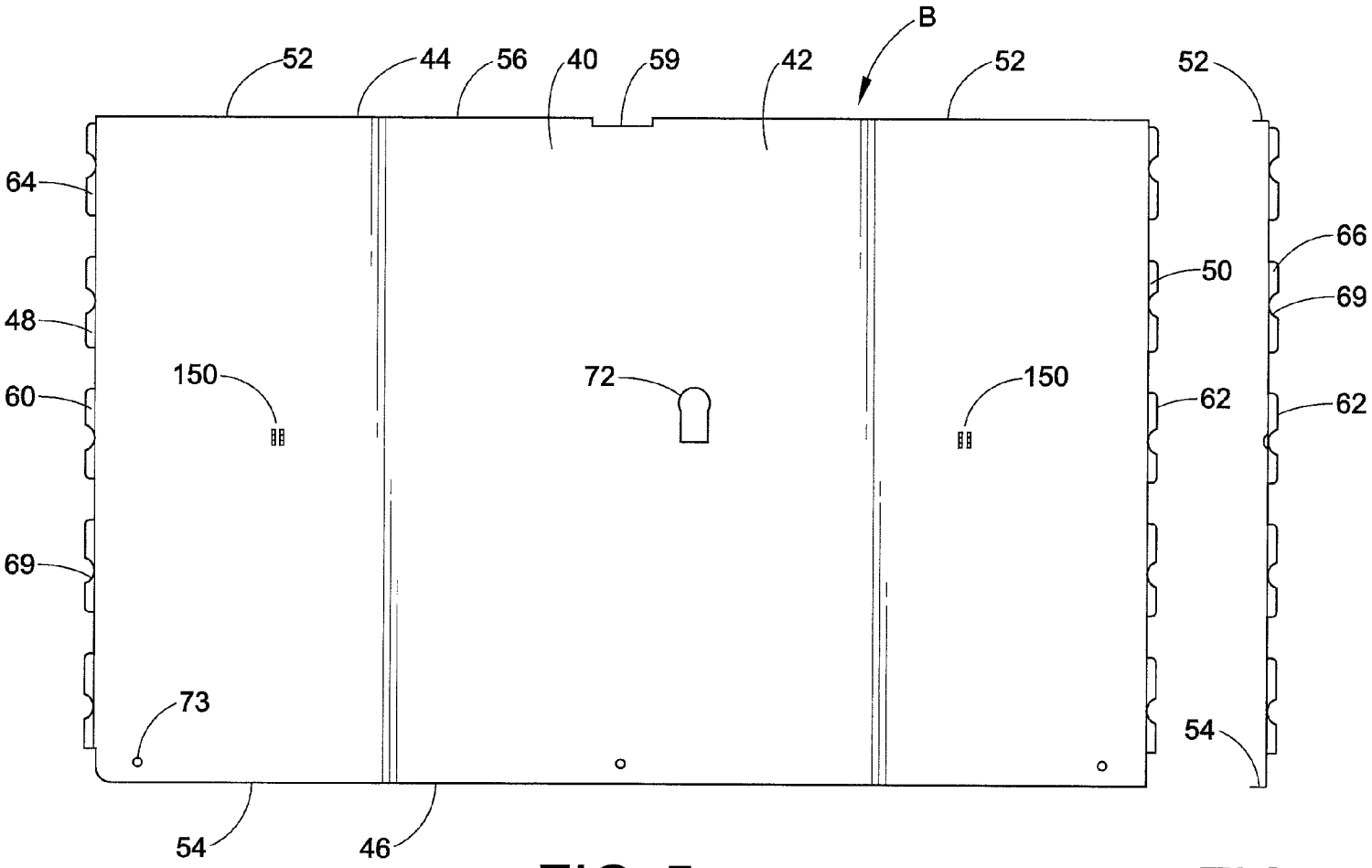
FIG. 5 is a top plan view of a bin retaining panel in accordance with another aspect of the disclosure.
FIG. 6 is a right side elevational view of the panel of FIG. 5.

Planar wall 42 has ends 44, 46, 48, 50 which form the rectangular conformation. Upper and lower ends 44, 46 each has a bent edge or wall 52, 54 which is bent upwardly (extending out of the page in FIG. 6) about 90 degrees with respect to wall 42 as shown in FIG. 6. Walls 52, 54 help retain and position doors on the cabinet in a closed configuration. The walls 52, 54 also help retain the panel in position and apply pressure to the panel via the door resting on the panel.

Figure 8:
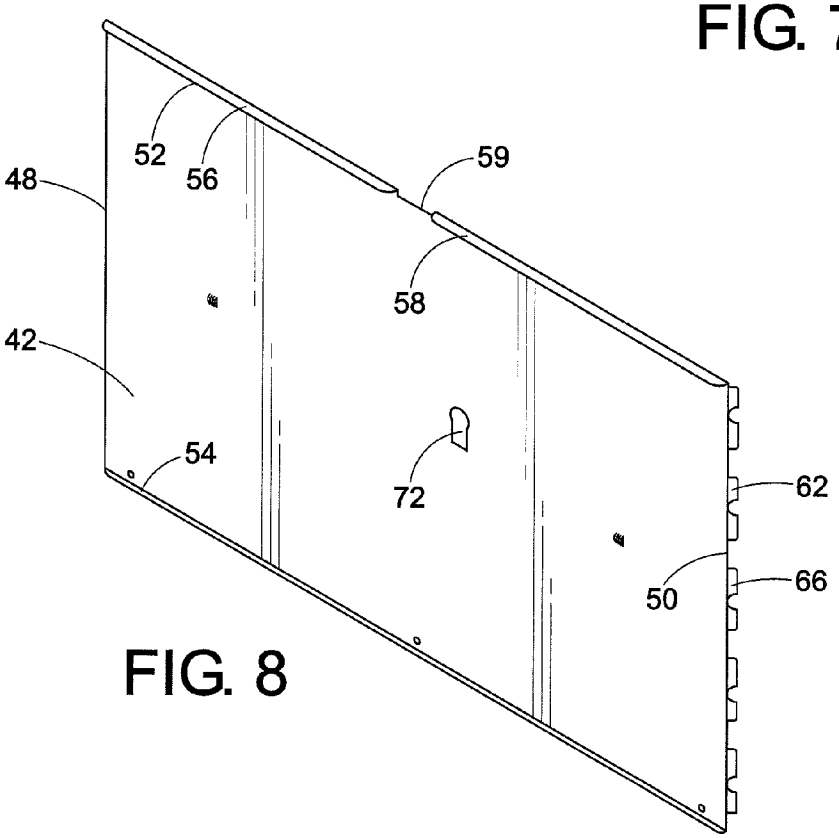
FIG. 8 is a perspective view of the panel of FIG. 5.

Wall 52 includes two half sections 56, 58 to accommodate the ends of the doors. A notch or gap 59 can be formed between wall sections 56, 58 to accommodate the ends of the two doors. As shown in FIG. 8, wall section 56, 58 each has curved or rounded edges. However, straight or angled edges are also contemplated.

Figure 7:
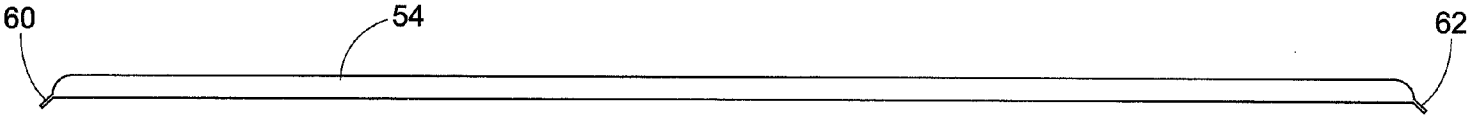
FIG. 7 is a front elevational view of the panel of FIG. 5.

Side ends 48, 50 each has a bent edge 60, 62 which is bent downwardly or into the page as seen in FIGS. 6 and 7. Edges 60, 62 are bent at an acute angle with respect to wall 42 at about 45 degrees or so. Other angles are also contemplated by the disclosure. Edges 60, 62 have a series of tabs or protrusions 64, 66 (such as rectangular or square shape or any suitable shape) which are sized and configured to engage mating slots 138 formed by shelves in the bin. Protrusions 64, 66 can have a C-shaped or rounded or curved slot 69 to accommodate a portion of the shelf. Positioned on the planar wall is a slot or opening 72 which is sized and configured to receive a correspondingly locking member for a door of the shipping container. A plurality of holes 73 on planar wall 42 can be used for hanging the panel when not in use.

Figure 9:
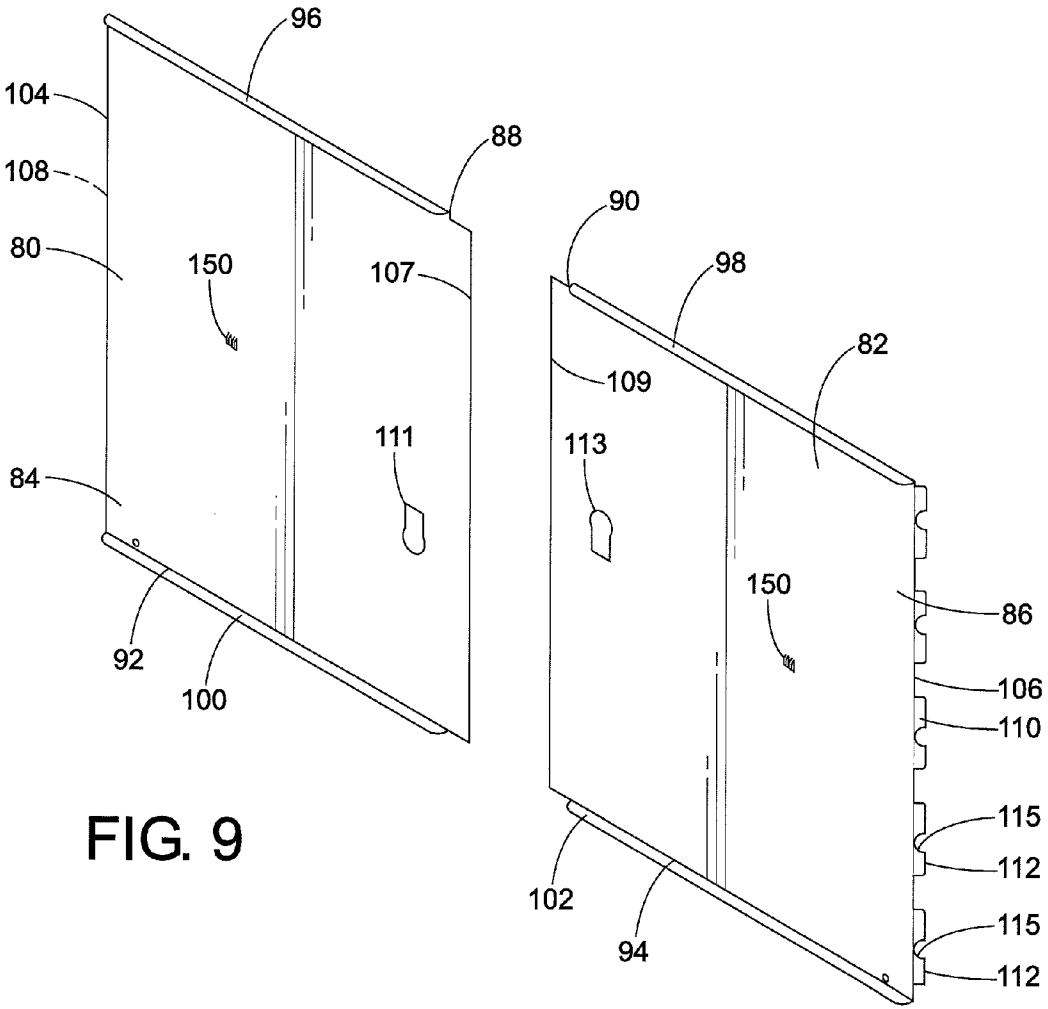
FIG. 9 is a perspective view of a two-piece bin retaining panel in accordance with another aspect of the disclosure.

Referring now to FIG. 9, another alternate embodiment of the bin retaining panel assembly is shown. This embodiment has two half panels 80, 82 each of which has planar walls 84, 86 and upper and lower ends 88, 90, 92, 94 which have bent edges 96, 98, 100, 102 bent at about 90 degrees with respect to planar walls 84, 86. These bent edges help align the doors on the panel and apply pressure to the panel via the doors. A gap is formed between panels 80, 82 to accommodate the two doors. Side ends 104, 106 each has a bent edge 108, 110 bent downwardly at about 45 degrees with respect to planar walls 84, 86. Edges 108, 110 have a plurality of tabs or protrusions 112 which engage slots 138 formed by shelves of the storage bin for aligning the panel and retaining it in position. Tabs 112 can have a substantially rectangular or square shape and can have a round or curved slot or notch 115 formed therein. Inner ends 107, 109 do not have bent edges.

Each of the planar walls can also have a cut-out or opening 111, 113 to accommodate a lock member of the bin door. Also, the panels 80, 82 can be configured to be used in a first orientation or a second orientation rotated 180 degrees with respect to the first orientation.

Figure 10:
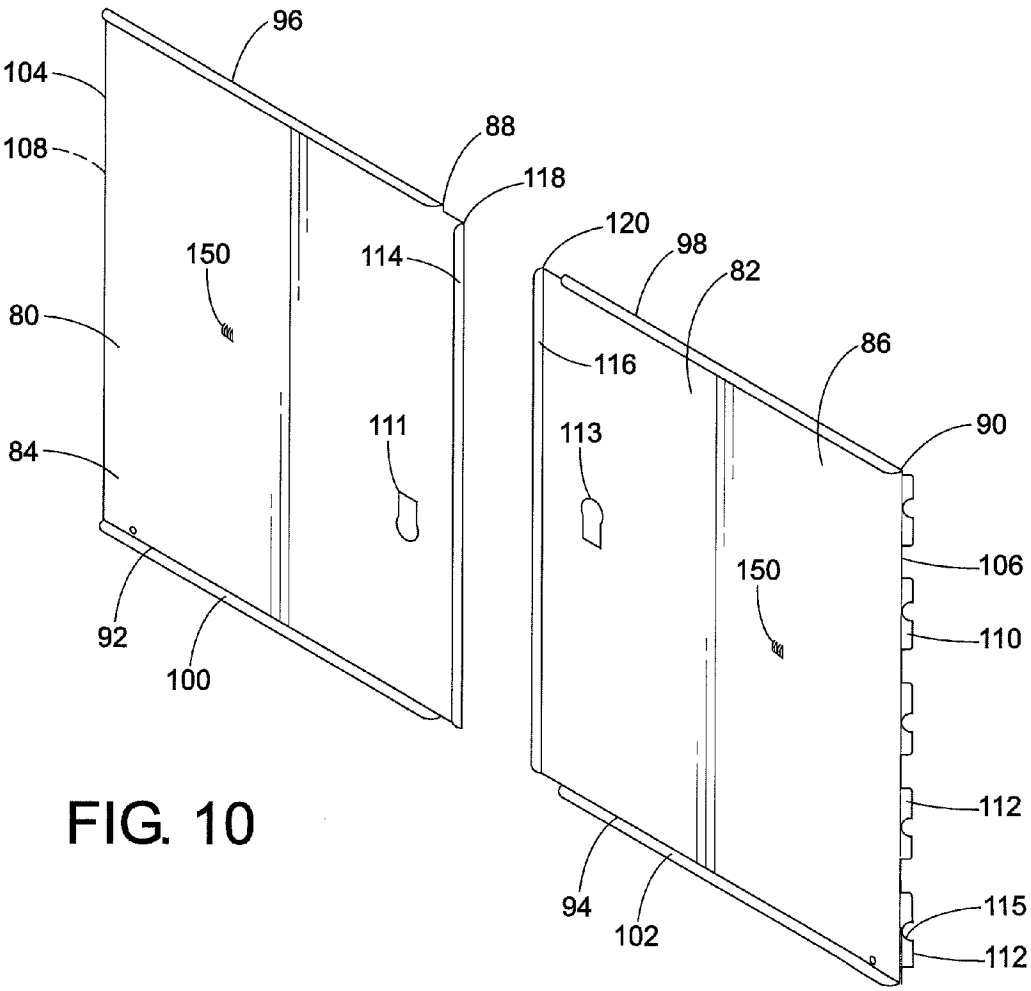
FIG. 10 is a perspective view of a two-piece retaining panel assembly in accordance with still another aspect of the disclosure.

Referring to FIG. 10, another alternate embodiment is shown. This embodiment is essentially the same as described for FIG. 9, but additional bent edges 114, 116 are formed on ends 118, 120 of the panels 80, 82.

Each of the bent edges accommodate the door frames of the bin and puts additional pressure on the panel to stay in position by contacting the door frame. A gap is formed between the panels 80, 82 to accommodate the two doors' edges.

Figure 11:
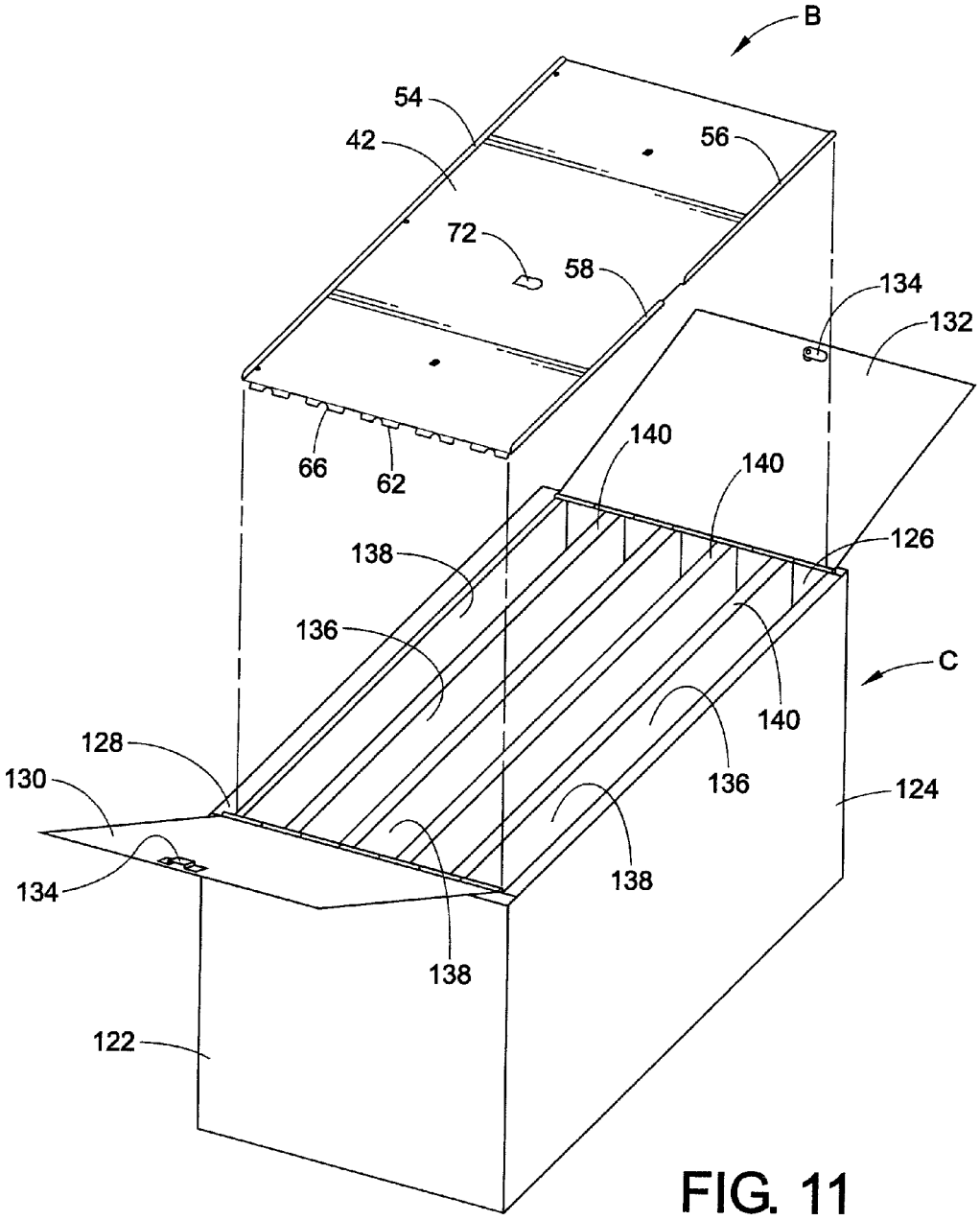
FIG. 11 is a perspective view of a bin retaining panel of FIG. 5 being lowered onto a storage bin in accordance with one aspect of the disclosure.
Figure 12:
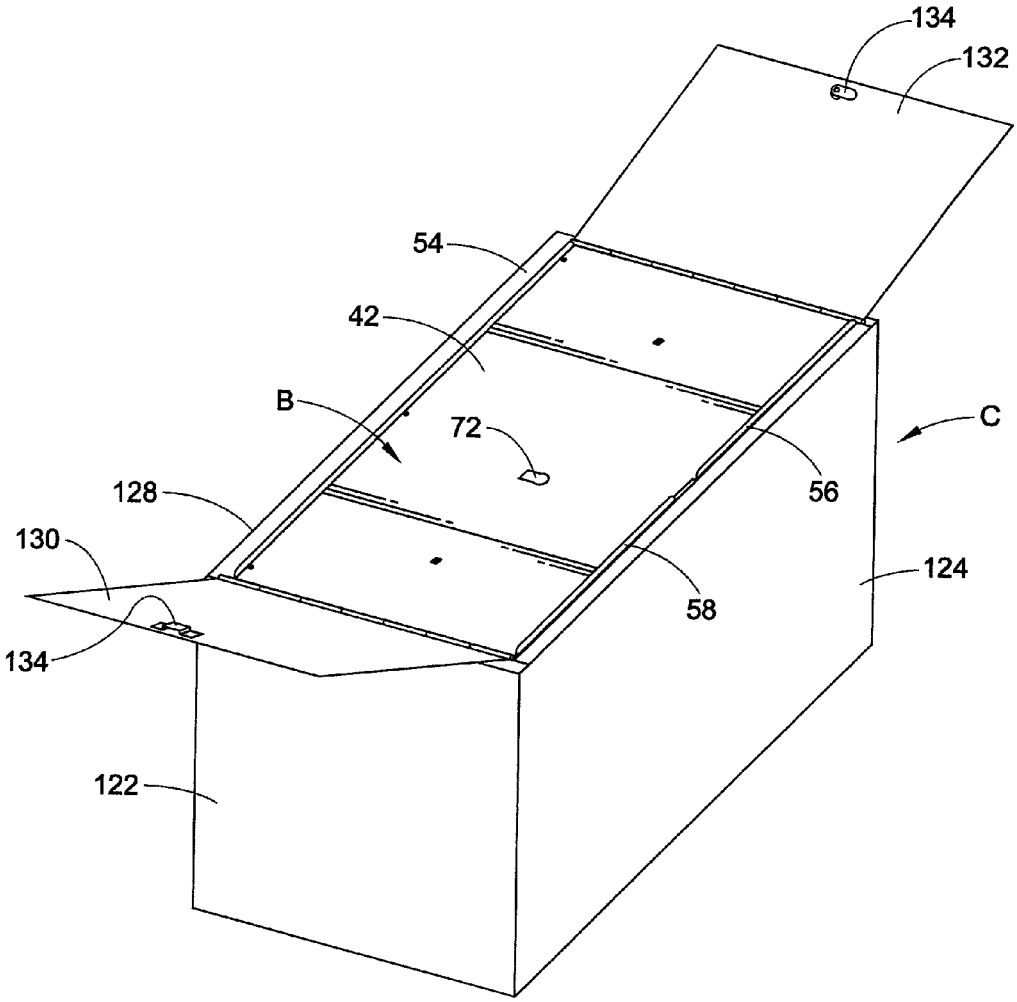
FIG. 12 is a perspective view of the bin retaining panel of FIG. 5 in an installed position on a storage bin.

Referring now to FIGS. 11 and 12, installation of a bin retaining panel B (shown in FIGS. 5-8) onto a storage bin C is shown. Bin C has a plurality of side walls 122, 124, 126, 128 and two hinged doors 130, 132 which have a locking member assembly 134. A plurality of shelves 136 are positioned within the bin. Bin panel B is lowered onto the end of the bin when the bin is tilted on its side. That is, shelves 136 are positioned vertically in this orientation or at about 90 degrees with respect to the panel B. Shelves 136 form a series of slots or openings 138 which matingly receive and engage bent tabs 64, 66 formed on edges 60, 62 of the panel. This helps align the panel and retain it in position on the bin.

Referring to FIG. 12, the panel B can be flexed or bent sufficiently to engage the tabs 64, 66 with slots 138 of the shelves. The panel then rests horizontally on or is positioned on outer edges 140 of the shelves 136. The doors 130, 132 are then closed wherein the bent edges 54, 56, 58 of the panel contact the edges of the doors to help retain the panel in position and allow the doors apply pressure to the panel. The doors are then locked and the locking member is received within opening 72. The bin is then placed in a storage or shipping container and is shipped. The steps described for FIGS. 11 and 12 also apply to the panels shown in FIGS. 1-4 and FIGS. 9 and 10.

When the bin arrives at the user destination, the doors are unlocked and removed, and the panel is removed by pulling on the cut-out or opening 72 on the panel. Alternatively, rings or cable retaining members 150 can be formed on each of the planar walls to accommodate cable ties, straps, zip ties, etc. to pull the panel out of engagement with the bin.

The exemplary embodiment has been described with reference to a preferred embodiment. Obviously, modifications and alterations will occur to others upon the reading and understanding of this specification. The specification is intended to include all such modifications and alterations insofar as they come within the scope of the appended claims or the equivalents thereof.

The invention claimed is:

1. A bin retainer panel, comprising:

a planar wall having a first end comprising a bent edge extending along a length of said first end; and first and second outer side ends each having edges bent at an acute angle with respect to said planar wall; wherein said first and second outer side ends are perpendicular to said first end;

wherein said bent edges of said first and second side ends each comprise a plurality of protrusions wherein said protrusions extend along a length of a respective bent edge and C-shaped notches are formed within each of said protrusions.

2. The bin retainer panel of claim 1, further comprising a second end opposite said first end, wherein said second end does not have a bent edge.

3. The bin retainer panel of claim 1, wherein said protrustions are substantially rectangular in shape.

4. The bin retainer panel of claim 3, wherein said notches are substantially rounded in shape.

5. The bin retainer panel of claim 1, further comprising at least one slot for accommodating an associated lock of an associated cabinet.

6. The bin retainer panel of claim 1, wherein said bent edges of said first and second side ends are bent about 45 degrees with respect to said planar wall.

7. The bin retainer panel of claim 1, wherein said first end edge is bent at substantially 90 degrees with respect to said planar wall.

8. The bin retainer panel of claim 1, wherein said first end comprises first and second sections, wherein said first and second sections comprise rounded edges.

9. The bin retainer panel of claim 8, wherein a gap is formed between said first and second sections of said first end.

10. The bin retainer panel of claim 1, further comprising a second end opposite said first end, wherein said second end comprises an edge bent at substantially 90 degrees to said planar wall.

* * * * *